United States Patent [19]

Reece

[11] 4,352,872

[45] Oct. 5, 1982

[54] STABILIZATION OF LATENT IMAGES IN PHOTOTHERMOGRAPHIC ELEMENTS

[75] Inventor: Jack E. Reece, Forest Lake, Minn.

[73] Assignee: Minnesota Mining and Manufacturing Company, St. Paul, Minn.

[21] Appl. No.: 239,011

[22] Filed: Feb. 27, 1981

[51] Int. Cl.[3] ..... G03C 1/02

[52] U.S. Cl. ..... 430/523; 430/600; 430/613; 430/614; 430/617; 430/618; 430/619; 430/620

[58] Field of Search ..... 430/523, 600, 613, 614, 430/617, 618, 619, 620

[56] References Cited

U.S. PATENT DOCUMENTS 3,457,075 7/1969 Morgan et al. ..... 430/619

4,036,649 7/1977 Schwalenstocker ..... 430/600

*Primary Examiner*—Won H. Louie, Jr.

*Attorney, Agent, or Firm*—Cruzan Alexander; Donald M. Sell; Mark A. Litman

[57] ABSTRACT

Photothermographic emulsions may be stabilized against latent image fade and/or may have their speed increased by the addition of diazepines and fused aromatic diazepines.

13 Claims, No Drawings

STABILIZATION OF LATENT IMAGES IN PHOTOTHERMOGRAPHIC ELEMENTS

TECHNICAL FIELD

The present invention relates to silver halide photothermographic emulsions and in particular to latent image stabilization of photothermographic emulsions.

BACKGROUND OF THE ART

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image.

The specks or clusters of silver which form the latent image are only partially stable. Materials within the emulsion can oxidize the metallic silver back to an ionic state. This in fact occurs in photothermographic emulsions. The quality and the optical density of a photothermographic image will, because of this latent image decay, in part depend on the time period between exposure and development. The time period over which noticeable latent image fade will occur varies with the ambient conditions, but at room temperature and moderate humidity, visually observable changes can be readily seen with a decay of twelve hours between exposure and development. It would, of course, be desirable to reduce latent image fade in photothermographic emulsions without adversely affecting the sensitometry of the emulsion or requiring extensive formulation changes.

SUMMARY OF THE INVENTION

The addition of diazepines and fused aromatic diazepines to photothermographic emulsions has been found to suppress latent image fade and also, in some instances, to modestly increase the relative speed of the emulsions. As defined in the present invention, diazepines are compounds having a central nucleus

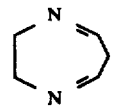

and benzodiazepines are compounds having a central nucleus

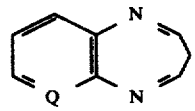

including acid-stabilized complexes of these compounds.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

The diazepines and fused aromatic diazepines of the present invention contain a nucleus selected from the group of

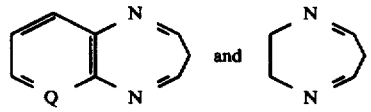

wherein Q is selected from N and C.

The substitution of these nuclei has been found to variously affect the degree of improvement afforded by these compounds, but all substituted diazepines and fused aromatic diazepines provide some improvement to the emulsion. In particular, diazepines and fused aromatic diazepines of one of the following formulae are preferred:

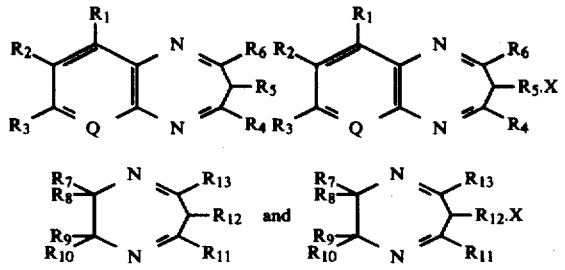

wherein $R_1$, $R_2$ and $R_3$ may be selected from H, alkyl (substituted or not, from 1 to 20 carbon atoms), alkoxy (substituted or not, from 1 to 20 carbon atoms), halogen (preferably Cl, Br, and I), carboxy, aryl preferably phenyl, substituted or not, from 6 to 20 carbon atoms), and nitro, $R_4$, $R_5$ and $R_6$ may be selected from H, alkyl (substituted or not, from 1 to 20 carbon atoms), alkoxy (substituted or not, from 1 to 20 carbon atoms), aryl (preferably phenyl, substituted or not, from 6 to 20 carbon atoms), halogen (preferably Cl, Br, and I), and nitro, $R_7$, $R_8$, $R_9$ and $R_{10}$ may be selected from H, alkyl (substituted or not, from 1 to 20 carbon atoms), alkoxy (substituted or not, from 1 to 20 carbon atoms), aryl (preferably phenyl, substituted or not, from 6 to 20 carbon atoms), and halogen (preferably Cl, Br, and I), $R_{11}$, $R_{12}$ and $R_{13}$ may be selected from H, alkyl (substituted or not, from 1 to 20 carbon atoms), alkoxy (substituted or not, from 1 to 20 carbon atoms), aryl (preferably phenyl, substituted or not, from 6 to 20 carbon atoms), and halogen (preferably Cl, Br and I), and X is an acid, for example, HCl, HBr, $HBF_4$, and $H_2SO_4$.

In describing materials useful according to the present invention, the use of the term 'group' to characterize a class, such as alkyl group, indicates that substitution of the species of that class is anticipated and included within that description. For example, alkyl group includes hydroxy, halogen, ether, nitro, aryl and carboxy substitution while alkyl includes only unsubstituted alkyl.

In the above description of groups, all alkyl and alkoxy groups are preferably 1 to 4 carbon atoms, and aryl groups are preferably phenyl.

The latent image stabilizers may be present in any effective amount. This is usually in the range of 0.001 to 0.5 percent by weight of the material in the imaging layer. The stabilizer may be added to the top layer in a two coat system, but is must migrate in an effective amount into the image layer to be useful according to the practice of the present invention.

As previously noted, various other adjuvants may be added to the photothermographic emulsions of the present invention. For example, toners, accelerators, acutance dyes, sensitizers, stabilizers, surfactants, lubricants, coating aids, antifoggants, leuco dyes, chelating agents, and various other well known additives may be usefully incorporated.

A simple test has been used in the following examples to determine the relative effectiveness of the compounds of the present invention. A standard photothermographic emulsion was prepared without any diazepine or fused aromatic diazepine therein. Two strips of the standard film and two strips of each of the films with the additives of the present invention were exposed for one millesecond on a Mark VII, E. G. and G. sensitometer to a 5000 m-candle-sec xenon flash. One strip of each pair of film samples was immediately developed by heating at 125°-130° C. for twenty-five seconds. Each of the other samples was placed in an oven at 60° C. for twenty minutes and then developed in the same manner. The apparent energy of the exposure (Log E) needed to generate an optical density of 1.0 upon this standard development was determined. The increase in energy needed to obtain this optical density between identically composed samples was termed latent image fade and is expressed as Log E units. All percentages, unless otherwise indicated in the discussion of compositions, are weight percentages.

PREPARATION

A master emulsion was prepared for use in all of the examples of the present invention as follows:

Three thousand grams of a dispersion containing 12.5 percent by weight silver behenate, 6.5 percent methyl isobutyl ketone, 21 percent toluene, and 60 percent methyl ethyl ketone were added to a stirred reaction vessel and maintained at 15° C. Forty-five (45) grams of polyvinyl butyral and thirty (30) grams 1-methyl-2-pyrrolidinone were added with stirring. At twenty minute intervals, the following additions were made:

(1) a mixture of 75 ml 2 M HBr and 20 ml 0.1 M HI in ethanol, (2) 330 grams polyvinyl butyral and 15 ml 0.5 M $HgBr_2$ in ethanol, and (3) 80 mg of the sensitizing dye

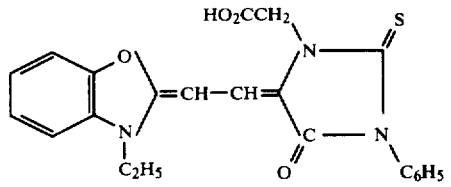

in 16 ml of 1-methyl-2-pyrrolidinone. The mixture was digested with stirring for twenty minutes.

To a 700 gram aliquot of this master batch was added 9 grams of a hindered phenol developer (1,1-bis(2-hydroxy-3,5-dimethylphenyl)-3,5,5-trimethylhexane) and 3 grams of phthalazinone. After stirring for 20 minutes at 15° C., this was knife-coated at 100 microns wet thickness onto polyester and dried in a forced draft at 85° C. for 4 minutes. Top coats containing the additives of the present invention (or nothing in the case of the control) in a 5 percent solids solution of a polyvinyl acetate/polyvinyl chloride copolymer (80/20) in methyl ethyl ketone were applied to the dried first coating at 65 microns wet thickness and dried in the same manner as the first coating. Equimolar amounts (equivalent to 12 mg of the compound of Example 4) of the additives were used.

In two cases, the polyester base was primed with a solution of 5 parts polyvinylpyrrolidone, 19 parts ethanol, and 76 parts methyl ethyl ketone before application of the silver containing layer. Each of these coatings were 65 microns wet thickness and were dried as above, one as the control and the other containing 0.02 weight percent Compound 8.

COMPOUNDS OF THE EXAMPLES

The following Table identifies the compounds used in the Examples. Compounds 1-5 are diazepines and compounds 6-20 are benzodiazepines. Group X is indicated only on acidified compounds.

TABLE

| Compound | Q | $R_1$ | $R_2$ | $R_3$ | $R_4$ | $R_5$ | $R_6$ | $R_7$ | $R_8$ | $R_9$ | $R_{10}$ | $R_{11}$ | $R_{12}$ | $R_{13}$ | X |
|---|---|---|---|---|---|---|---|---|---|---|---|---|---|---|---|
| 1 | | | | | | | | H | H | H | H | $CH_3$ | H | $CH_3$ | |
| 2 | | | | | | | | H | H | $CH_3$ | H | $CH_3$ | H | $CH_3$ | |
| 3 | | | | | | | | H | H | $CH_3$ | $CH_3$ | $CH_3$ | H | $CH_3$ | HCl |
| 4 | | | | | | | | H | H | H | H | $CH_3$ | Br | $CH_3$ | HBr |
| 5 | | | | | | | | H | H | H | H | $CH_3$ | $C_2H_5$ | $CH_3$ | |
| 6 | CH | H | H | H | H | H | H | | | | | | | | HCl |
| 7 | CH | H | H | H | $CH_3$ | H | H | | | | | | | | |
| 8 | CH | H | H | H | $CH_3$ | H | H | | | | | | | | HCl |
| 9 | CH | H | H | H | $CH_3$ | H | H | | | | | | | | $HBF_4$ |
| 10 | CH | H | H | H | $CH_3$ | H | H | | | | | | | | $H_2SO_4$ |
| 11 | CH | H | H | H | $C_6H_5$ | H | H | | | | | | | | HCl |
| 12 | CH | H | $CH_3$ | H | $CH_3$ | H | H | | | | | | | | |
| 13 | CH | H | $CH_3$ | $CH_3$ | $CH_3$ | H | H | | | | | | | | |
| 14 | CH | H | Cl | H | $CH_3$ | H | H | | | | | | | | |
| 15 | CH | H | $OCH_3$ | H | $CH_3$ | H | H | | | | | | | | |
| 16 | CH | H | $NO_2$ | H | $CH_3$ | H | H | | | | | | | | |
| 17 | CH | H | $CO_2H$ | H | $CH_3$ | H | H | | | | | | | | |
| 18 | CH | $NO_2$ | H | H | $CH_3$ | H | H | | | | | | | | |
| 19 | N | H | H | H | $CH_3$ | H | H | | | | | | | | |
| 20 | CH | H | H | H | $CH_3$ | H | $C_6H_5$ | | | | | | | | $H_2SO_4$ |

EXAMPLES 1-23

These data show the Latent Image Fade (LIF) and speed effects of the compounds of the present invention on photothermographic emulsions.

| Ex. | Cmpd. | LIF | Initial Rel. Speed |
|---|---|---|---|
| 1 | Control | 1.1 | 100 |
| 2 | 6 | 1.05 | 87 |
| 3 | 7 | 0.47 | 115 |
| 4 | 8 | 0.40 | 138 |
| 5 | 9 | 0.39 | 87 |
| 6 | 10 | 0.71 | 69 |
| 7 | 11 | 0.79 | 98 |
| 8 | 12 | 0.62 | 107 |
| 9 | 13 | 0.54 | 145 |
| 10 | 14 | 0.52 | 95 |
| 11 | 15 | 0.55 | 120 |
| 12 | 16 | 0.90 | 100 |
| 13 | 17 | 0.74 | 102 |
| 14 | 18 | 1.05 | 81 |
| 15 | 19 | 1.09 | 158 |
| 16 | 20 | 0.97 | 138 |
| 17 | 1 | 0.62 | 338 |
| 18 | 2 | 0.83 | 295 |
| 19 | 3 | 1.24 | 158 |
| 20 | 4 | 0.90 | 219 |
| 21 | 5 | 0.70 | 331 |
| 22 | Control[1] | 1.7 | 123 |
| 23 | 8[2] | 0.5 | 257 |

[1]primed
[2]primed with compound 8 in primer layer

As can be seen from these data, fading of the latent image was suppressed in all but one instance, in which case the speed was still significantly increased (Example 19). The data are limited evidence that tertiary carbons are not preferred on the diazepine ring.

EXAMPLES 24-38

To a 350 gram portion of the master batch was added 4.8 grams of the hindered phenol developer of Examples 1-23 and 2.4 grams phthalazinone. Seven twenty (20) gram aliquots were separated and treated individually with various weight percent solutions of compound 8 in ethanol so that the final concentrations were those shown in the following Table. Knife coatings were prepared and dried as in the previous Examples, then overcoated with the resin solution used for the first control in Example 1. Testing was performed as previously described and the results shown below.

From the remainder of the batch, an additional eight emulsion coatings were prepared as before (Examples 1–23). In these cases, however, the overcoat solutions contained various amounts of Compound 8 in the resin. Compositions and the results of the testing are also shown (Examples 30–37) in the Table below. These Examples show the effects of concentrations with 2,4-dimethyl-3H-1,5-benzodiazepine (Compound 8) on latent image fade and speed.

| Ex. | Wt Per Cent (Cmpd 8) | Location | LIF | Initial Rel Speed |
|---|---|---|---|---|
| 24 | 0 | | 0.68 | 100 |
| 25 | 0.001 | emulsion | 0.53 | 58 |
| 26 | 0.005 | emulsion | 0.31 | 95 |
| 27 | 0.01 | emulsion | 0.12 | 110 |
| 28 | 0.02 | emulsion | 0.07 | 186 |
| 29 | 0.04 | emulsion | 0.03 | 174 |
| 30 | 0.08 | emulsion | 0.08 | 91 |
| 31 | 0.005 | overcoat | 0.66 | 112 |
| 32 | 0.01 | overcoat | 0.44 | 138 |
| 33 | 0.0125 | overcoat | 0.35 | 132 |
| 34 | 0.015 | overcoat | 0.23 | 170 |
| 35 | 0.0175 | overcoat | 0.23 | 155 |
| 36 | 0.02 | overcoat | 0.25 | 204 |
| 37 | 0.025 | overcoat | 0.26 | 219 |
| 38 | 0.03 | overcoat | 0.15 | 200 |

As can be seen from these Examples, the concentration range of the additives of the present invention is quite broad for both latent image fade suppressance and speed increases.

EXAMPLES 39–40

To 175 grams of the master batch of the previous Examples was added 2.25 grams of the hindered phenol of Example 1, 0.38 grams phthalazine, and 0.75 grams 4-methyl phthalic acid. The mixture was stirred for 20 minutes and two knife coated samples on polyester were prepared as in previous Examples. One sample was overcoated with only the resin solution of the previous Examples and the other with the resin solution containing 0.02 weight percent Compound 8. The results are shown below:

| Example | Wt % Cmpd 8 | L.I.F. | Initial Rel. Speed |
|---|---|---|---|
| 39 | 0 | 0.2 | 100 |
| 40 | 0.02 | 0.1 | 269 |

These results show that even in systems having a naturally greater resistance to latent image fade (here due to the phthalazine and 4-methyl phthalic acid toner system), the compounds of the present invention can still significantly further reduce fade and increase the speed of the emulsion.

I claim:

1. A photothermographic element comprising a binder, light sensitive silver halide in catalytic proximity to a light insensitive silver source material in said element which contains a reducible source of silver ions, a reducing agent for silver ion and an effective latent image stabilizing amount of a compound selected from the class consisting of diazepines and fused aromatic diazepines having a central nucleus selected from the group consisting of

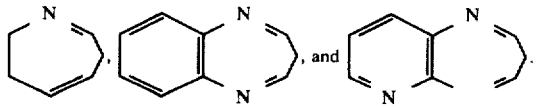

2. The photothermographic element of claim 1 wherein said binder, silver halide, silver source material, reducing agent and said compound are present in a single layer.

3. The photothermographic element of claim 1 wherein said compound is in a layer adjacent to a layer containing both of said silver halide and said silver source material.

4. The photothermographic element of claim 3 wherein said element comprises (1) a substrate, (2) an emulsion layer comprising a binder and light sensitive silver halide in catalytic proximity to said silver source material, and (3) an overcoat layer comprising a binder and said compound.

5. The photothermographic emulsion of claims 1, 2, 3 or 4 in which said diazepine or fused aromatic diazepine is included within one of the formulae:

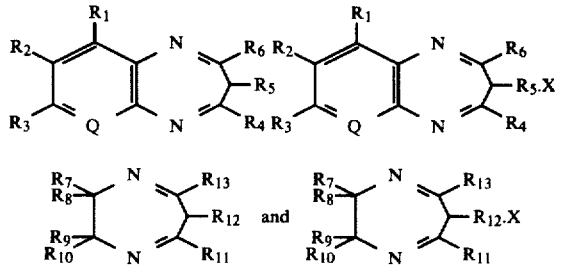

wherein $R_1$, $R_2$, and $R_3$ may be selected from H, alkyl groups of 1 to 20 carbon atoms, alkoxy groups of 1 to 20 carbon atoms, halogen, carboxy, aryl groups of up to 20 carbon atoms, and nitro, $R_4$, $R_5$ and $R_6$ may be selected from H, alkyl groups of 1 to 20 carbon atoms, alkoxy groups of 1 to 20 carbon atoms, aryl groups of up to 20 carbon atoms, nitro, and halogen, $R_7$, $R_8$, $R_9$ and $R_{10}$ may be selected from H, alkyl groups of 1 to 20 carbon atoms, alkoxy groups of 1 to 20 carbon atoms, aryl groups of up to 20 carbon atoms, and halogen, $R_{11}$, $R_{12}$ and $R_{13}$ may be selected from H, alkyl groups of 1 to 20 carbon atoms, alkoxy groups of 1 to 20 carbon atoms, aryl groups of up to 20 carbon atoms, and halogen, Q is selected from CH and N, and X is an acid.

6. The photothermographic element of claim 5 wherein said silver source material is a silver salt of a 10 to 30 carbon atom carboxylic acid.

7. The photothermographic element of claim 2 wherein said binder comprises 20 to 75 percent by weight of said single layer, said silver halide comprises 0.75 to 15 percent by weight of said single layer, said silver source material comprises a reducible silver salt of an organic acid from 20 to 70 percent by weight of said single layer, said reducing agent comprises from 1 to 10 percent by weight of said single layer, and said compound comprises from 0.001 to 0.5 percent by weight of said single layer.

8. The photothermographic element of claim 4 wherein said emulsion layer is comprised of 20 to 75 percent by weight binder, 0.75 to 15 percent by weight silver halide, 20 to 70 percent silver source material, and 1 to 10 percent by weight of reducing agent for silver ion, and said overcoat layer comprises a binder with 0.001 to 0.5 percent by weight of said compound.

9. The photothermographic element of claims 7 and 8 wherein said silver source material is a silver salt of a 15 to 28 carbon atom carboxylic acid and said compound is represented by either of the formulae:

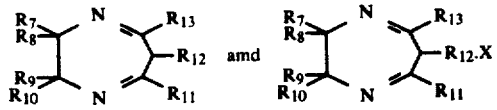

wherein $R_7$, $R_8$, $R_9$ and $R_{10}$ are selected from the group consisting of H, alkyl of 1 to 4 carbon atoms, alkoxy of 1 to 4 carbon atoms, phenyl, carboxy, halogen, and nitro with the proviso that at least one of both (a) $R_7$ and $R_8$ and (b) $R_9$ and $R_{10}$ be H, and $R_{11}$, $R_{12}$ and $R_{13}$ are selected from the group consisting of H, alkyl of 1 to 4 carbon atoms, alkoxy of 1 to 4 carbon atoms, phenyl and halogen.

10. The photothermographic element of claims 7 and 8 wherein said silver source material is a silver salt of a 15 to 28 carbon atom carboxylic acid and said compound is represented by either of the formulae:

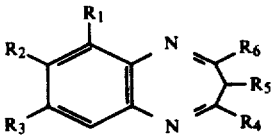

-continued

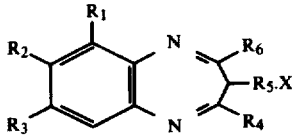

wherein $R_1$, $R_2$ and $R_3$ are selected from H, alkyl of 1 to 4 carbon atoms, alkoxy of 1 to 4 carbon atoms, halogen, carboxy, phenyl, and nitro, and $R_4$, $R_5$ and $R_6$ are selected from H, alkyl of 1 to 4 carbon atoms, alkoxy of 1 to 4 carbon atoms, phenyl, halogen, and nitro.

11. The photothermographic element of claim 9 wherein $R_7$, $R_8$, $R_9$, $R_{10}$, $R_{11}$, $R_{12}$ and $R_{13}$ are selected from H and alkyl of 1 to 2 carbon atoms.

12. The photothermographic element of claim 10 wherein $R_1$, $R_2$, $R_3$, $R_4$, $R_5$ and $R_6$ are selected from H and alkyl of 1 to 2 carbon atoms.

13. The photothermographic element of claims 7 or 8 wherein said compound is selected from the class of

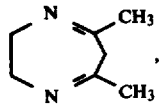

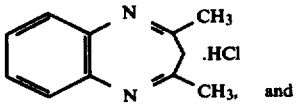

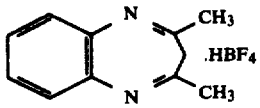

* * * * *